US005867907A

United States Patent [19]

Terry et al.

[11] Patent Number: 5,867,907

[45] Date of Patent: Feb. 9, 1999

[54] SHAVING SYSTEMS

[75] Inventors: John Charles Terry, Tilehurst; Frank Edward Brown, Maidenhead; Stephen Leonard Rawle, Headley Down, all of England

[73] Assignee: The Gillette Company, Boston, Mass.

[21] Appl. No.: 768,284

[22] PCT Filed: Apr. 4, 1990

[86] PCT No.: PCT/US90/01853

§ 371 Date: Nov. 13, 1991

§ 102(e) Date: Nov. 13, 1991

[87] PCT Pub. No.: WO90/11875

PCT Pub. Date: Oct. 18, 1990

[30] Foreign Application Priority Data

Apr. 13, 1989 [GB] United Kingdom ..... 8908329

[51] Int. Cl.[6] ..... B26B 21/24; B65D 83/10

[52] U.S. Cl. ..... 30/40.2; 206/356

[58] Field of Search ..... 30/40.2, 50, 87, 30/157; 221/103, 303; 206/354, 356, 359

[56] References Cited

U.S. PATENT DOCUMENTS

| | | | |
|---|---|---|---|
| 2,744,317 | 5/1956 | Borden | 30/40 |
| 2,744,318 | 5/1956 | Borden | 30/40 |
| 2,821,779 | 2/1958 | Kleinman | 20/40.2 |
| 3,797,657 | 3/1974 | Petrillo | 206/356 |
| 3,880,284 | 4/1975 | Pomfret | 30/40.2 |
| 4,043,035 | 8/1977 | Pentney | 206/356 |
| 4,090,638 | 5/1978 | Pentney | 206/356 |
| 4,140,244 | 2/1979 | Clabby | 206/356 |
| 4,492,025 | 1/1985 | Jacobson | 30/87 |
| 4,742,909 | 5/1988 | Apprille, et al. | 206/356 |
| 4,978,031 | 12/1990 | Lembke | 206/356 |

*Primary Examiner*—Rinaldi I. Rada
*Assistant Examiner*—Paul M. Heyrana, Sr.
*Attorney, Agent, or Firm*—Donal B. Tobin

[57] ABSTRACT

A shaving system including a handle, a container and a plurality of blade cartridges accommodated in the container. The handle is selectively engageable and disengageable with said cartridges. A guide is provided to enable the handle to pass over a plurality of cartridges in a row in the container and to engage only the last cartridge in the row.

6 Claims, 3 Drawing Sheets

SHAVING SYSTEMS

This invention relates to shaving systems, that is systems of the general form now in widespread use comprising a razor handle and a plurality of razor cartridges housed in a dispensing container from which they can be picked up one at a time by the handle and moved out of the container for use.

In some systems, the handle and cartridges have simple fixed slide structures for mutual engagement, but the present invention is particularly concerned with systems in which the handle has an operating mechanism comprising latch means which are manually operable for engagement and disengagement of the cartridges, and aims at the provision of such a system in which the manipulation required to engage a cartridge is greatly simplified.

The invention provides such a system in which the user merely has to pass the razor head through guide means provided in the dispenser in order to pick up a cartridge and, as an optional preliminary, to deposit a used cartridge in the container.

More particularly, the invention provides a shaving system comprising a razor handle, a plurality of exchangeable blade cartridges and a dispensing container housing a plurality of the cartridges, the handle being provided with a pair of arms for engaging and disengaging cartridges with and from the handle, wherein the container houses a plurality of cartridges side-by-side and is formed with a guide means extending longitudinally of the container, transverse to the lengths of the cartridges, from one, entry end to the opposite, exit end of the container, the arrangement being such that the razor handle can be engaged in the container at the entry end thereof, and moved along the length of the container, clear of the cartridges, except for the last cartridge nearest the exit end with which it is brought into operative engagement, the guide means cooperating with the said arms to move them into a disengaged condition until the handle reaches the last cartridge, whereat the arms are returned to their operative positions to engage the last cartridge.

One form of system in accordance with the invention will now be described in detail, by way of example, with reference to the accompanying drawings, in which.

Figure 1:
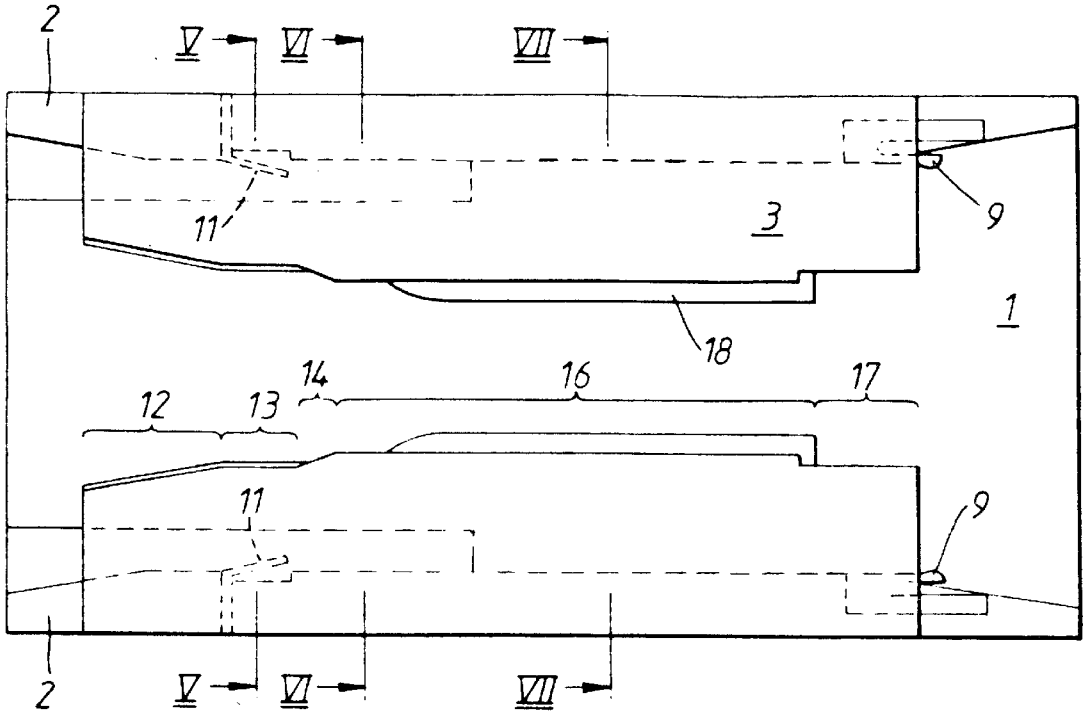
FIG. 1 is a top plan view of the system.

In the shaving system illustrated in the drawings, the razor handle H and cartridges C have the general form described and illustrated in U.S. Pat. No. 4492025 and International Publication Number WO 85/01466, to which reference is hereby directed, and relevant parts of the razor and cartridge are given the same reference numerals as in the said U.S. Publication. In particular, the razor comprises a grip portion 72, cartridge engaging arms 78, 80 and a spring loaded plunger 104 having a free end portion 106. The arms 78, 80 are operable to disengage a cartridge by pressing them inwardly towards each other against a resilient restoring force. The plunger 104 acts as a releasable locking means which locks the arms 78, 80 in their disengaged position.

The cartridges each have depending extensions which are engageable by the arms 78, 80 to secure the cartridge in operative engagement with the handle, and concave cam surfaces for engagement by the free end 106 of plunger 104.

The above described razor handle and cartridges were designed for manual operation for engaging and disengaging cartridges. Assuming a used cartridge to be in position on the handle, the user presses in the arms 78, 80 to disengage the arms from the extensions to release the cartridge. To engage a new cartridge, the user brings the head of the handle into engagement with the underside of the cartridge, thereby depressing the plunger 104 to trigger release of the arms, which spring out to engage the new cartridge in its operative position.

The storage dispenser illustrated in FIGS. 1 to 7 hereof comprises a generally rectangular casing of moulded plastics construction, which may be open at both ends.

The dispenser comprises a continuous bottom wall 1, continuous side-walls 2 and a top wall 3 having an opening along its full length.

Figure 2:
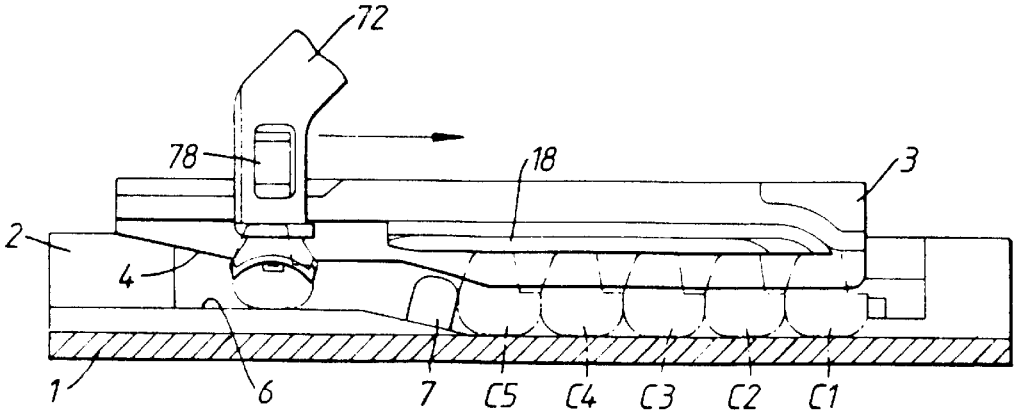
FIGS. 2, 3 and 4 are longitudinal sections, showing the container full of cartridges and a razor handle in successive operative position along the container.
Figure 3:
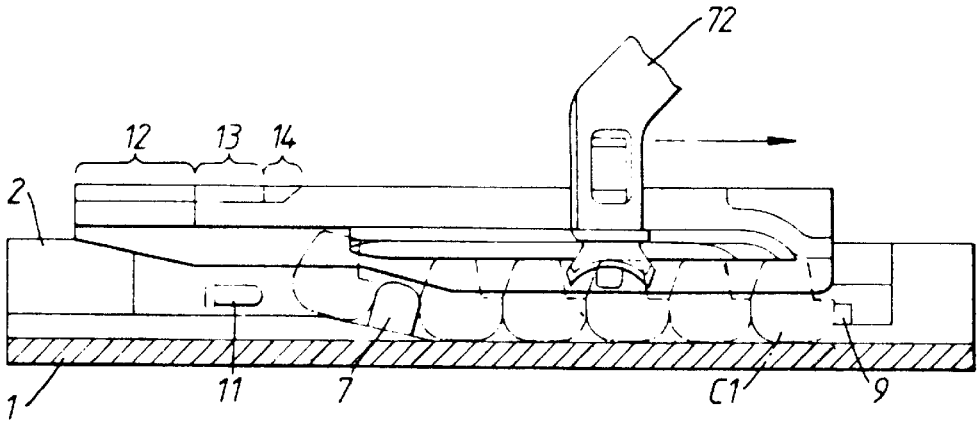

In FIG. 2, the dispenser is shown fully loaded with a plurality of fresh cartridges (shown in phantom line) C1 to C5, ready for use, the first cartridge to be used being shown in position C1 at the right-hand or exit end of the dispenser. The cartridges are held side-by-side in the dispenser by their ends slidably engaging in guide-slots at both sides of the dispenser formed by upper and lower cam formations 4, 6. Also located and guided by these guide slots is a moulded separator 7 whose initial position, shown in FIG. 2, is at a downwardly sloping portion of the slots. Over the following region, the guide slots are rectilinear and parallel with the main plane of the dispenser.

At the exit region of the dispenser, the vertical side walls of the guide slots are formed with small, rounded protrusions which constitute resilient friction stops 9 to prevent inadvertent movement of the cartridges out of the exit end and at the lefthand, entry end, the dispenser is formed integrally with spring catches 11 which serve to prevent return movement of cartridges which have passed them.

The top wall 3 is formed with a slot, or track-way for guiding the razor handle through the dispenser.

The slot in the top wall is contoured, as viewed in FIG. 1 to have a flared entry section 12, a parallel sided section 13, inwardly directed ramps 14, followed by a parallel-sided section 16 of reduced width and a wider, parallel sided exit section 17. Parallel guide rails 18 are provided over a major portion of the section 16.

The shaped slot provides lateral guidance of the razor handle through the dispenser, and it is also guided and restrained vertically over the major part of the length of the parallel-sided section 16 by the guide rails 18 which engage under fixed projecting portions of the razor handle.

Figure 5:
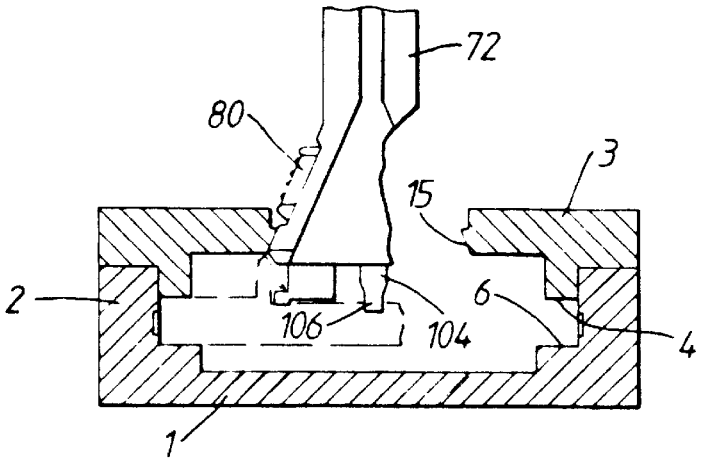
FIGS. 5, 6 and 7 are cross-sections taken at the lines V—V, VI—VI and VII—VII, respectively in FIG. 1.

In FIG. 2, the dispenser is shown with a razor handle carrying a used cartridge having been introduced into the entry end of the dispenser, as far as the parallel sided section 13, in which the solid part of the handle is located and guided by the chamfered sides 15 of the slot, as shown in FIG. 5. The handle is positioned vertically by its engagement with the sloping sides edges of the slot on the one hand, and by engagement of the cartridge with the cam formations 4, 6 on the other. In the next stage of movement, through the ramps 14, the cartridge passes the spring catches 11 which will now prevent its withdrawal through the entry end, and the ramps 14 depress the arms 78, 80, which will remain depressed until the plunger 104 is next operated. The used cartridge is thus disengaged and deposited in the guide slots. The handle next engages the upper surface of the separator 7, and moves it forwardly to take up any play which might exist between the separator and the unused cartridges C5 to C1. The separator is resilient and its upper end is designed to flex out of engagement from the razor handle when all the clearances have been taken up.

In the next stage of movement, (FIGS. 3 and 7) the handle is engaged from below by the guide rails It, which ensure that it cannot engage the underlying cartridges C5 to C2.

Figure 4:
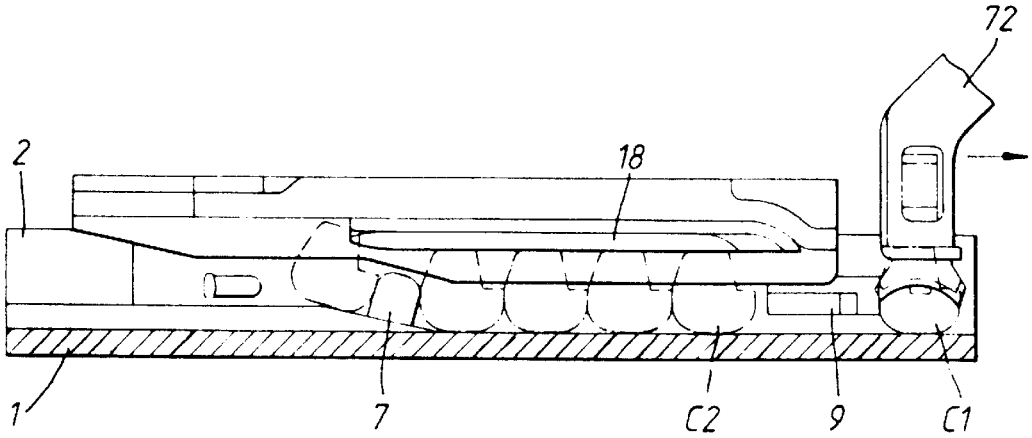
Figure 6:
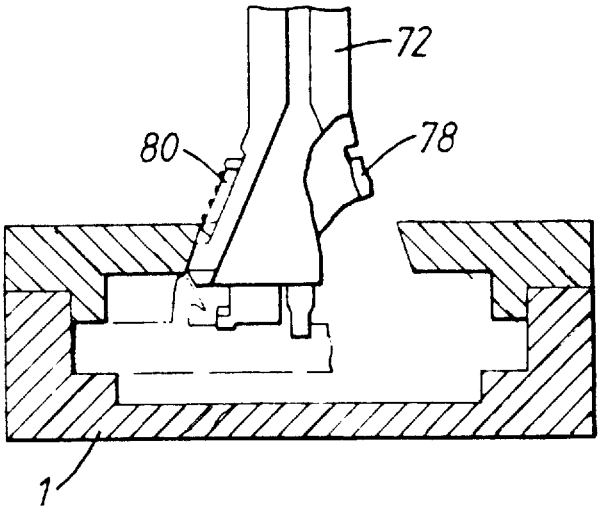
Figure 7:
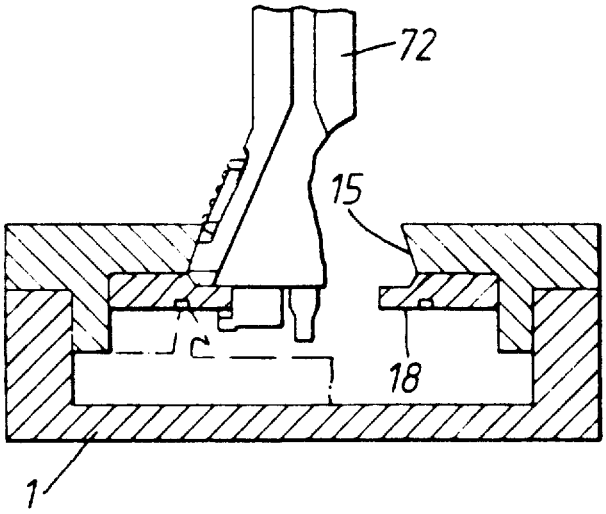

In the last region of the narrow section 16, the guide rails 18 and the overlying chamfered sides 15 of the guide slots curve sharply downwardly to carry the handle down towards the cam surfaces of the last cartridge (C1), causing the plunger to be depressed and thereby release the arms 78, 80. At substantially the same instant, the handle reaches the wider, exit section 17 of the slot and the arms spring out into their position of engagement with cartridge (C1), which is now operatively coupled to the handle. Finally, the cartridge, now fully engaged by the handle, forces its way past the stops 9 and then emerges from the dispenser (FIG. 4). This cycle of depositing a used cartridge and picking up a fresh one is repeated at intervals until the last cartridge (C5) has been removed so that the last position is then occupied by the separator 7. It is not essential for an old cartridge to be deposited, since the interference between the separator and the head of the razor will ensure that the separator is advanced each time the head is passed through the dispenser.

The system is particularly convenient in use, since the user only has to pass the handle through the dispenser in a steady continuous movement to deposit a used cartridge and pick up a new one.

The separator 7 is always readily visible so as to indicate the number of cartridges remaining for use.

The system is readily adapted to use of cartridges having individual overcaps, for example in the form of open topped boxes. In that case, the boxes are engaged by their ends in the guide slots and the handle emerges secured to a cartridge carrying its own overcap, which is then manually removed and, if desired, replaced between shaves to protect the blades.

In an alternative embodiment, the releasable locking means of the handle are omitted, and the arms must be held in their position of disengagement throughout the travel of the handle through the dispenser. This is achieved by suitable shaping of the main slot in the top wall, whose edges remain in contact with the arms, until the handle reaches the exit end of the container. At this point the arms are abruptly released and allowed to spring outwardly to engage the last cartridge. In such an embodiment, it is preferred that the handle is guided along a rectilinear path and the last cartridge is pushed up a ramp to meet the handle.

A possible modification, applicable to both embodiments, resides in providing a transverse end wall at each end of the dispenser. Such a wall at the entry end facilitates correct introduction of the handle to the guide slot and at the outlet end provides a positive indication that loading of a fresh cartridge has been completed.

Many other variations and modifications will of course be possible within the scope of the invention.

We claim:

1. A shaving system comprising a razor handle, a plurality of exchangeable blade cartridges adapted to fit the handle and a dispensing container housing said plurality of the cartridges, the handle being provided with a pair of arms for engaging and disengaging cartridges with and from the handle, wherein the container houses a plurality of cartridges side-by-side and is formed with a guide means extending longitudinally of the container, transverse to the lengths of the cartridges, from one, entry end to the opposite, exit end of the container, the arrangement being such that the razor handle can be engaged in the container at the entry end thereof, and moved along the length of the container, clear of the cartridges, except for the last cartridge nearest the exit end with which it is brought into operative engagement, the guide means including means for cooperating with the said arms to move them into a disengaged condition until the handle reaches the last cartridge, whereat the arms are returned to their operative positions to engage the last cartridge.

2. A system according to claim 1, wherein the guide means comprises an opening throughout the length of the top wall of the container in which the razor handle is located and guided, and guide slots in which opposite ends of the cartridges are located, the said slots and top wall converging towards each other towards the exit end of the container.

3. A system according to claim 2, comprising a separator element positioned in the guide slots between the entry end and the cartridges and releasably engageable by the razor head as it travels along the dispenser to urge the separator against cartridges and thereby move them towards the exit end, where the last cartridge is restrained from further movement until engaged with the handle.

4. A system according to claim 2, wherein the said guide slots are arranged, at the entry end of the container, to receive a used cartridge already mounted on the handle, the used cartridge being disengaged from the handle by engagement of the handle on the said opening, the used cartridge thereafter being retained in the container.

5. A system according to claim 2, wherein the razor handle further comprises a releasable locking means for retaining the said arms in their disengaged condition, the said opening for the razor handle being formed as a longitudinal opening whose sides are shaped to guide the handle laterally and to move the arms into their disengaged condition in which they are retained until the said locking means is tripped by engagement with the last cartridge to release the arms.

6. A system according to claim 2, in which the opening for the razor handle is formed as a longitudinal opening whose sides are shaped to guide the handle laterally, and to operate the arms into their position of disengagement and to maintain that position until the handle reaches the last cartridge, whereat the arms are returned to their position of engagement.

* * * * *